US009300045B2

(12) United States Patent
Wong et al.

(10) Patent No.: US 9,300,045 B2
(45) Date of Patent: Mar. 29, 2016

(54) COMMUNICATION DEVICE WITH ANTENNA ELEMENT

(71) Applicant: Acer Incorporated, New Taipei (TW)

(72) Inventors: Kin-Lu Wong, New Taipei (TW); Zih-Guang Liao, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 15 days.

(21) Appl. No.: 14/338,691

(22) Filed: Jul. 23, 2014

(65) Prior Publication Data

US 2015/0333403 A1 Nov. 19, 2015

(30) Foreign Application Priority Data

May 16, 2014 (TW) ..... 103117263 A

(51) Int. Cl.

| | |
|---|---|
| ***H01Q 1/50*** | (2006.01) |
| ***H01Q 5/50*** | (2015.01) |
| ***H01Q 5/20*** | (2015.01) |
| ***H01Q 5/335*** | (2015.01) |
| ***H01Q 5/30*** | (2015.01) |

(52) U.S. Cl.
CPC . *H01Q 5/50* (2015.01); *H01Q 5/20* (2015.01); *H01Q 5/30* (2015.01); *H01Q 5/335* (2015.01)

(58) Field of Classification Search
CPC ..... H01Q 5/50; H01Q 5/20; H01Q 5/30; H01Q 5/335
USPC ..... 343/857, 858, 860
See application file for complete search history.

(56) References Cited

U.S. PATENT DOCUMENTS

| | | | | |
|---|---|---|---|---|
| 7,528,785 | B2 * | 5/2009 | Forster | G06K 19/041 340/572.1 |
| 8,798,554 | B2 * | 8/2014 | Darnell | H01Q 5/35 333/132 |
| 8,884,831 | B2 * | 11/2014 | Amari | H01Q 1/243 343/700 MS |
| 9,070,975 | B2 * | 6/2015 | Collins | H01Q 1/242 |

FOREIGN PATENT DOCUMENTS

| | | |
|---|---|---|
| TW | 201340467 | 10/2013 |
| TW | M473615 | 3/2014 |

OTHER PUBLICATIONS

Taiwanese language office action dated Feb. 11, 2015, issued in application No. 103117263.

* cited by examiner

*Primary Examiner* — Brian Young
(74) *Attorney, Agent, or Firm* — McClure, Qualey & Rodack, LLP

(57) ABSTRACT

A communication device including a ground element and an antenna element is provided. The antenna element includes a metal element. The metal element is disposed adjacent to an edge of the ground element. The metal element has a first connection point and a second connection point. A feeding point of the antenna element is coupled through an inductive element to the first connection point. A first feeding path is formed from the feeding point through the inductive element to the first connection point. The feeding point of the antenna element is further coupled through a capacitive element to the second connection point. A second feeding path is formed from the feeding point through the capacitive element to the second connection point. The feeding point of the antenna element is further coupled through a matching circuit to a signal source.

14 Claims, 5 Drawing Sheets

COMMUNICATION DEVICE WITH ANTENNA ELEMENT

CROSS REFERENCE TO RELATED APPLICATIONS

This Application claims priority of Taiwan Patent Application No. 103117263 filed on May 16, 2014, the entirety of which is incorporated by reference herein.

BACKGROUND OF THE INVENTION

1. Field of the Invention

The disclosure generally relates to a communication device, and more particularly, to a communication device comprising a small-size dual-wideband monopole antenna element.

2. Description of the Related Art

In recent years, antenna elements of mobile communication devices usually use active switches to achieve their small-size and multi-band characteristics. By operating the active switches, the antenna elements can switch to different matching circuits in respective bands, or reconfigure themselves so as to obtain different resonant paths and achieve multi-band operation. However, the active switches are more complicated in the circuit design, and this leads to more complexity and higher manufacturing costs for the whole antenna system, and lower radiation efficiency of the antenna elements. Accordingly, it is a critical challenge for antenna designers to improve the design of active switches in mobile communication devices.

BRIEF SUMMARY OF THE INVENTION

The invention provides a communication device which comprises a small-size dual-wideband monopole antenna element. The antenna element with a small-size structure can cover LTE/WWAN (Long Term Evolution/Wireless Wide Area Network) dual wide bands (e.g., from about 698 MHz to about 960 MHz, and from about 1710 MHz to about 2690 MHz).

In a preferred embodiment, the invention is directed to a communication device, comprising: a ground element; and an antenna element, comprising a metal element, wherein the metal element is disposed adjacent to an edge of the ground element, the antenna element has a feeding point, the metal element has a first connection point and a second connection point, the feeding point is coupled through an inductive element to the first connection point, a first feeding path is formed from the feeding point through the inductive element to the first connection point, the feeding point is further coupled through a capacitive element to the second connection point, a second feeding path is formed from the feeding point through the capacitive element to the second connection point, and the feeding point is further coupled through a matching circuit to a signal source.

In some embodiments, the antenna element operates in a first band and a second band, and the frequencies of the first band are lower than the frequencies of the second band. In some embodiments, the first band is substantially from 698 MHz to 960 MHz, and the second band is substantially from 1710 MHz to 2690 MHz. By appropriately selecting the capacitance of the capacitive element and the inductance of the inductive element, the absolute value of the reactance of the capacitive element is greater than the absolute value of the reactance of the inductive element when the antenna element operates in the first band. Furthermore, the absolute value of the reactance of the capacitive element is less than the absolute value of the reactance of the inductive element when the antenna element operates in the second band. It should be understood that the feeding currents from the signal source substantially flow through the feeding path having a relatively small reactance. Therefore, when the antenna element operates in the first band (low-frequency band), the metal element is mainly fed through the first feeding path (including the inductive element) from the signal source. Conversely, when the antenna element operates in the second band (high-frequency band), the metal element is mainly fed through the second feeding path (including the capacitive element) from the signal source. The invention merely use passive components, and it can switch to the first feeding path in the low-frequency band, and switch to the second feeding path in the high-frequency band, such that different resonant paths are excited to cover dual bands.

It is noted that the inductive element of the first feeding path can provide an inductance to effectively reduce the resonant length of the metal element operating in the first band. As a result, the antenna element has the advantage of small size. In some embodiments, the length of the metal element is shorter than ⅛ wavelength (0.125λ) of the lowest frequency of the first band, and the proposed length is much shorter than ¼ wavelength (0.25λ) of a conventional design.

When the antenna element operates in the second band, the reactance of the inductive element is increased with the increase in the frequency, and therefore the inductive element has a relatively high reactance. Conversely, the reactance of the capacitive element is decreased with the increase in the frequency, and therefore the capacitive element has a relatively low reactance. Accordingly, when the antenna element operates in the second band, the metal element is mainly fed at the second connection point through the second feeding path from the signal source. In some embodiments, the capacitive element is a chip capacitor or a distributed capacitor. In some embodiments, the capacitive element, the inductive element, and the matching circuit are integrated on the same dielectric substrate, and they are all disposed between the metal element and the edge of the ground element. In some embodiments, the matching circuit is configured to increase the bandwidth of the first band and the second band concurrently. In some embodiments, the antenna element merely occupies a small clearance region having an area of $10\times30$ mm$^2$, and it can cover the two wide bands from about 698 MHz to about 960 MHz and from about 1710 MHz to about 2690 MHz.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Figure 1:
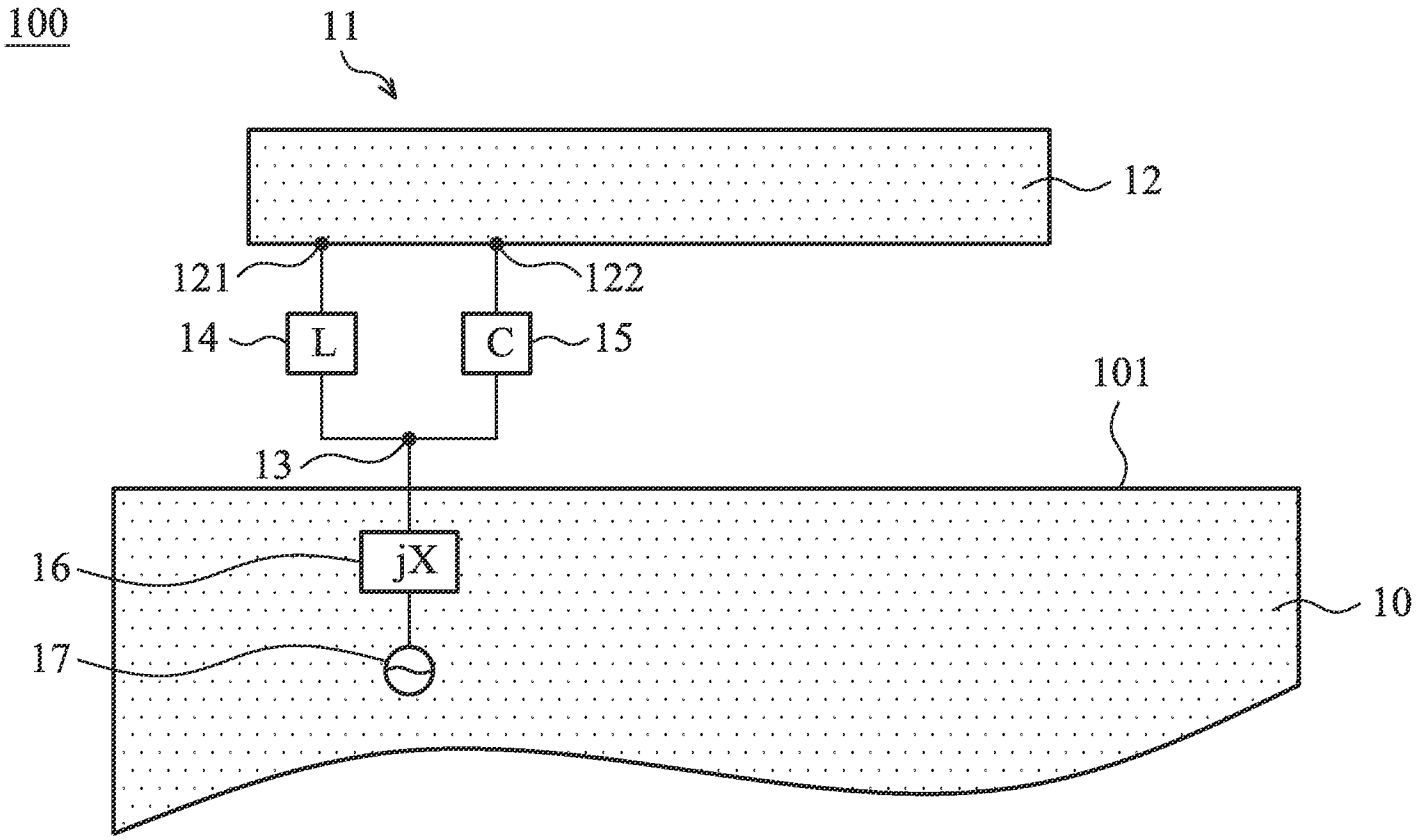
FIG. 1 is a diagram of a communication device according to a first embodiment of the invention.

FIG. 1 is a diagram of a communication device 100 according to a first embodiment of the invention. The communication device 100 may be a smartphone, a tablet computer, or a notebook computer. As shown in FIG. 1, the communication device 100 at least comprises a ground element 10 and an antenna element 11. The antenna element 11 comprises a metal element 12 and has a feeding point 13. The metal element 12 is disposed adjacent to an edge 101 of the ground element 10. The metal element 12 has a first connection point 121 and a second connection point 122. The feeding point 13 is coupled through an inductive element 14 to the first connection point 121, such that a first feeding path is formed from the feeding point 13 through the inductive element 14 to the first connection point 121. The feeding point 13 is further coupled through a capacitive element 15 to the second connection point 122, such that a second feeding path is formed from the feeding point 13 through the capacitive element 15 to the second connection point 122. In other words, the first feeding path and the second feeding path are coupled in parallel between the metal element 12 and the feeding point 13. The inductive element 14 may be a chip inductor, and the capacitive element 15 may be a chip capacitor. The feeding point 13 is further coupled through a matching circuit 16 to a signal source 17. The signal source 17 may be an RF (Radio Frequency) module of the communication device 100, and it can generate a feeding signal for exciting the antenna element 11. The matching circuit 16 may comprise one or more inductors and capacitors for adjusting the impedance matching of the antenna element 11. It is noted that the communication device 100 may further comprise other components, such as a touch panel, a processor, a speaker, a battery, and a housing (not shown).

Figure 2:
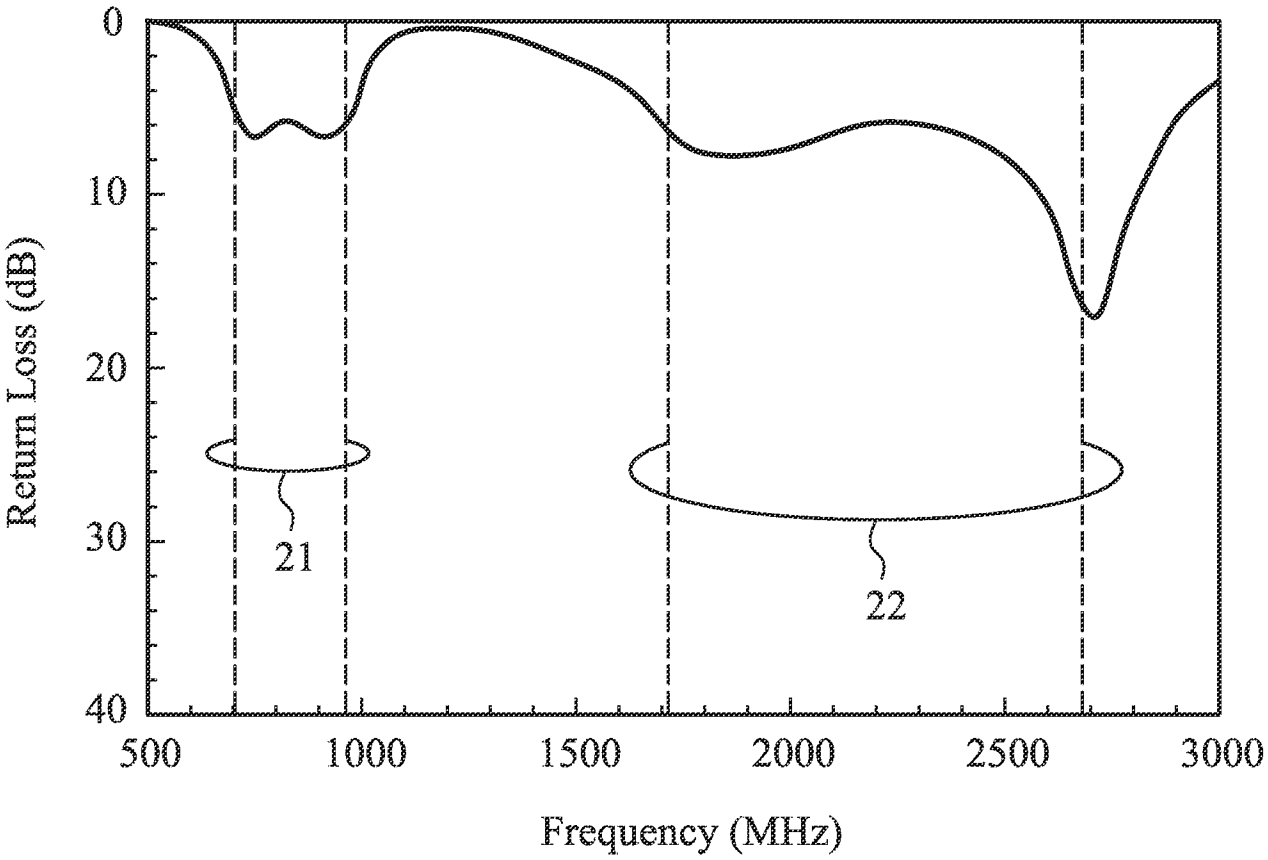
FIG. 2 is a diagram of return loss relative to an antenna element of a communication device according to a first embodiment of the invention.

FIG. 2 is a diagram of return loss relative to the antenna element 11 of the communication device 100 according to the first embodiment of the invention. In some embodiments, the element sizes and element parameters of the communication device 100 are set as follows. The ground element 10 has a length of about 200 mm and a width of about 150 mm. The clearance region occupied by the antenna element 11 has a length of about 30 mm and a width of about 10 mm. The metal element 12 has a length of about 30 mm. The inductive element 14 has an inductance of about 8 nH. The capacitive element 15 has a capacitance of about 0.9 pF. According to the measurement in FIG. 2, the antenna element 11 at least operates in a first band 21 and a second band 22 when the antenna element 11 is excited by the signal source 17. For example, the first band 21 may cover from about 698 MHz to about 960 MHz, and the second band 22 may cover from about 1710 MHz to about 2690 MHz. More particularly, the reactances of the inductive element 14 and the capacitive element 15 vary with a change in the operating frequency of the antenna element 11. In the first band 21, the absolute value of the reactance of the capacitive element 15 is greater than the absolute value of the reactance of the inductive element 14. In the second band 22, the absolute value of the reactance of the capacitive element 15 is less than the absolute value of the reactance of the inductive element 14. It should be understood that the feeding currents from the signal source 17 substantially flow through the feeding path having a relatively small reactance. As a result, when the antenna element 11 operates in the first band 21, the metal element 12 is mainly fed through the first feeding path (including the inductive element 14) from the signal source 17, and when the antenna element 11 operates in the second band 22, the metal element 12 is mainly fed through the second feeding path (including the capacitive element 15) from the signal source 17. The inductive element 14 provides an inductance to reduce the resonant length of the metal element 12 operating in the first band 21. For example, the length of the metal element 12 may be shorter than 0.125 (⅛) wavelength of the lowest frequency of the first band 21. The matching circuit 16 is configured to increase the bandwidth of the first band 21 and the second band 22. Therefore, the antenna element 11 of the invention can have a small size and support LTE/WWAN dual-wide-band operations.

Figure 3:
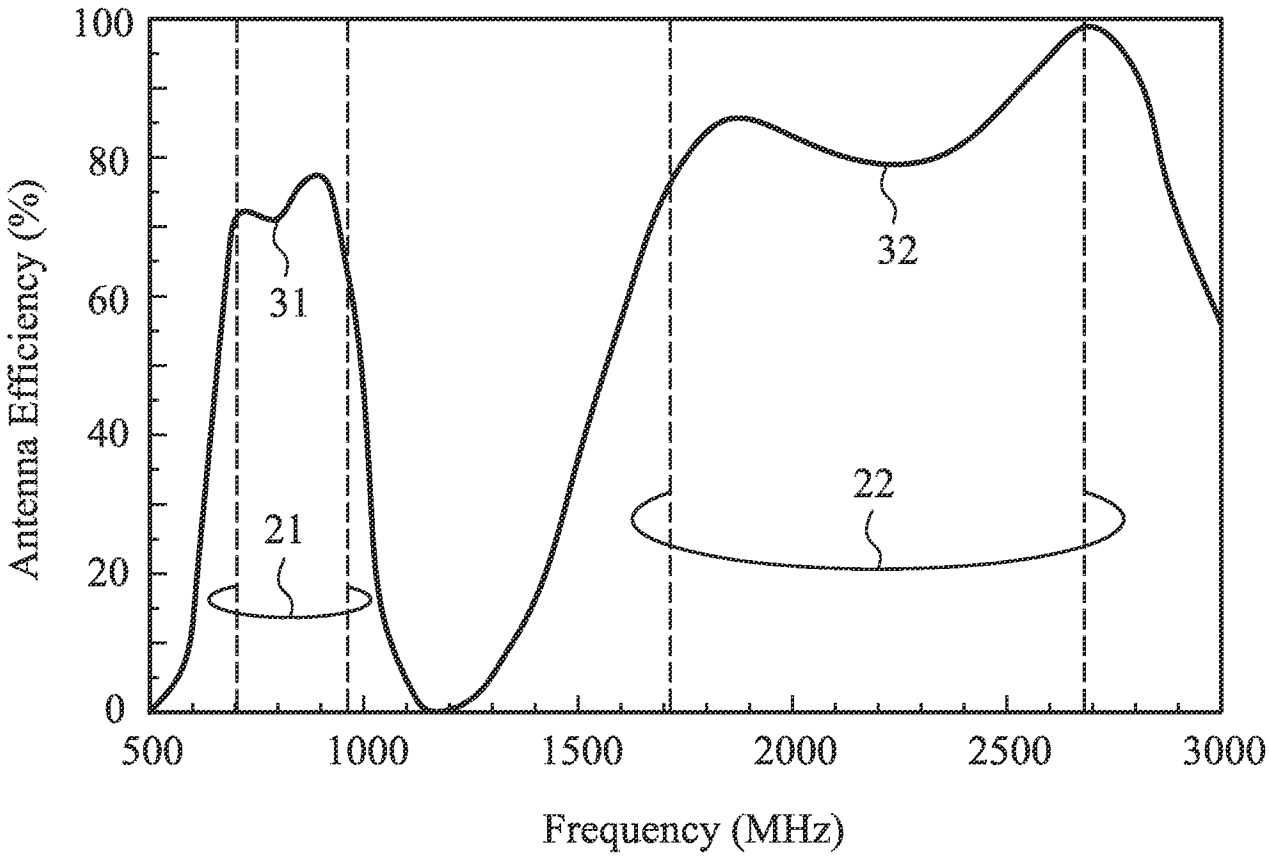
FIG. 3 is a diagram of antenna efficiency relative to an antenna element of a communication device according to a first embodiment of the invention.

FIG. 3 is a diagram of antenna efficiency relative to the antenna element 11 of the communication device 100 according to the first embodiment of the invention. It should be understood that the aforementioned antenna efficiency is radiation efficiency including return loss. According to the measurement in FIG. 3, the antenna efficiency curve 31 of the antenna element 11 operating in the first band 21 (from about 698 MHz to about 960 MHz) is from about 60% to about 75%, and the antenna efficiency curve 32 of the antenna element 11 operating in the second band 22 (from about 1710 MHz to about 2690 MHz) is from about 73% to about 97%. Therefore, the antenna efficiency of the antenna element 11 can meet the requirements of practical application in mobile communication devices.

Figure 4:
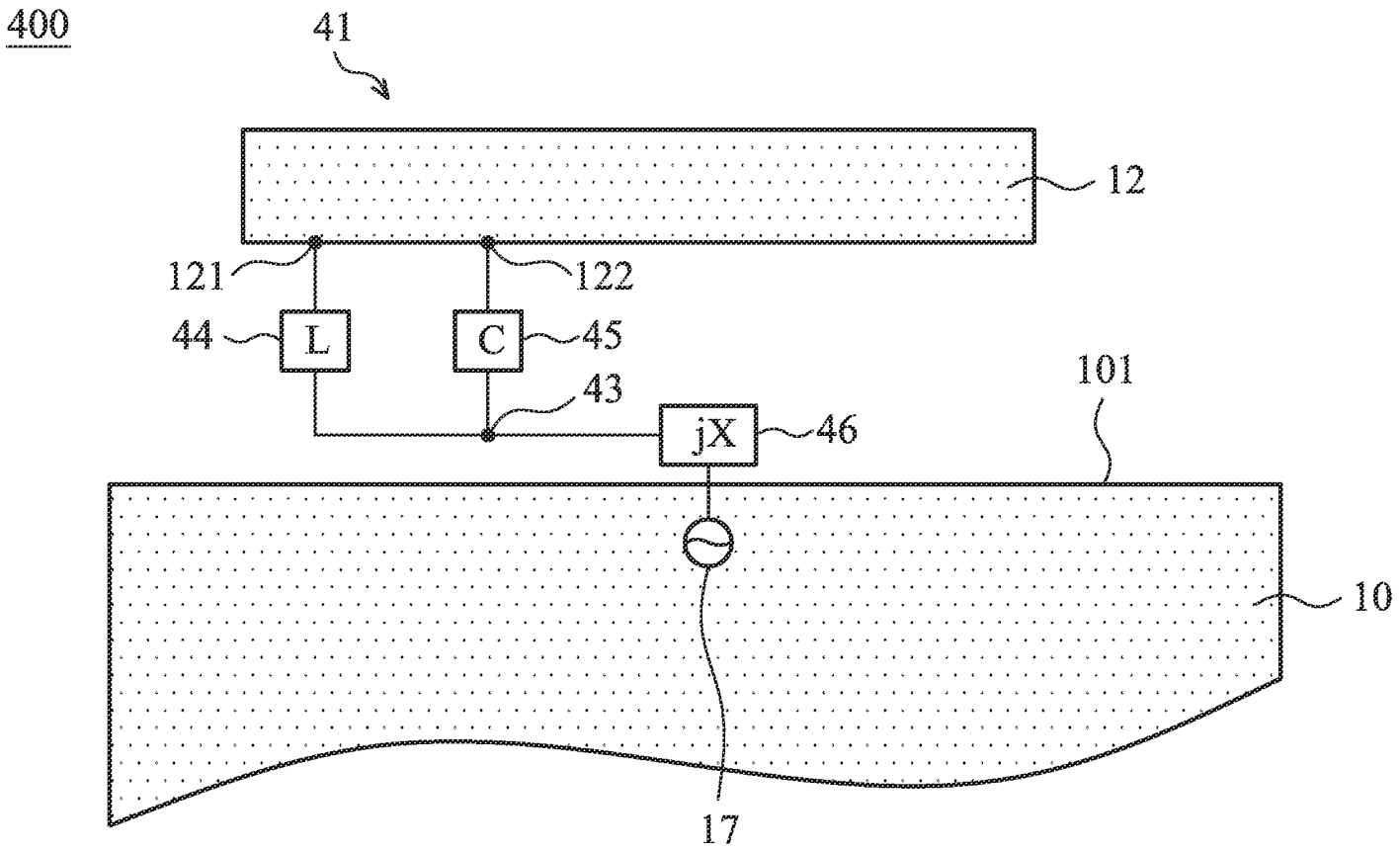
FIG. 4 is a diagram of a communication device according to a second embodiment of the invention.

FIG. 4 is a diagram of a communication device 400 according to a second embodiment of the invention. FIG. 4 is similar to FIG. 1. In the communication device 400 of the second embodiment, a matching circuit 46 is disposed inside a clearance region, rather than being on the ground element 10. The matching circuit 46 is positioned on the dielectric substrate on which an inductive element 44 and a capacitive element 45 are disposed. Other features of the communication device 400 of the second embodiment are similar to those of the communication device 100 of the first embodiment. Accordingly, the two embodiments can achieve similar levels of performance.

Figure 5:
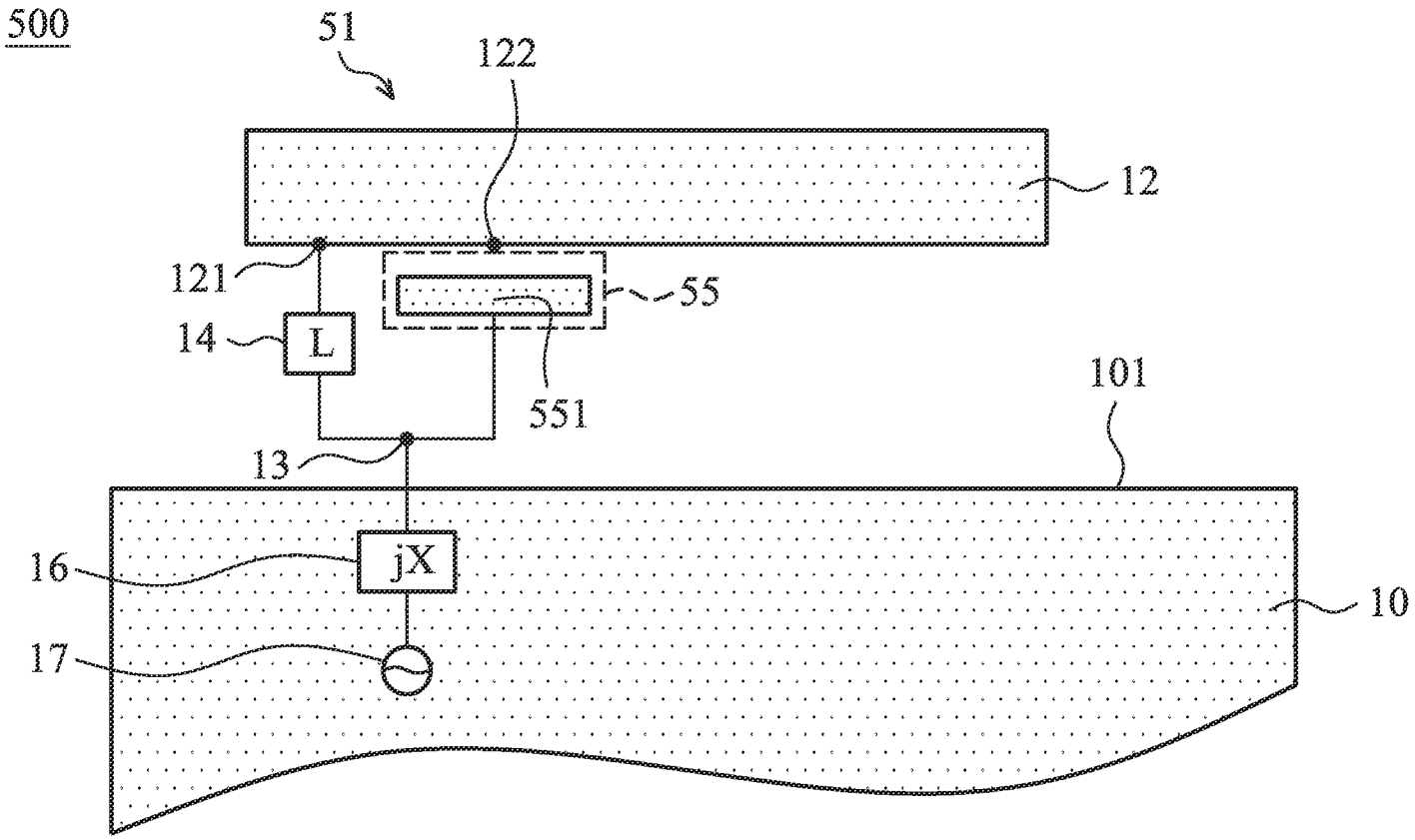
FIG. 5 is a diagram of a communication device according to a third embodiment of the invention.

FIG. 5 is a diagram of a communication device 500 according to a third embodiment of the invention. FIG. 5 is similar to FIG. 1. In the communication device 500 of the third embodiment, the capacitive element is a distributed capacitor 55. More particularly, the distributed capacitor 55 comprises a capacitively-coupling metal piece 551, and a coupling gap is formed between the capacitively-coupling metal piece 551 and the metal element 12. Other features of the communication device 500 of the third embodiment are similar to those of the communication device 100 of the first embodiment. Accordingly, the two embodiments can achieve similar levels of performance.

Note that the above element sizes, element shapes, and frequency ranges are not limitations of the invention. An antenna designer can fine tune these settings or values according to different requirements. It should be understood that the communication device and the antenna element of the invention are not limited to the configurations of FIGS. 1-5. The invention may merely include any one or more features of any one or more embodiments of FIGS. 1-5. In other words, not all of the features displayed in the figures should be implemented in the communication device and the antenna element of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element; and an antenna element, comprising a metal element, wherein the metal element is disposed adjacent to an edge of the ground element, the antenna element has a feeding point, the metal element has a first connection point and a second connection point, the feeding point is coupled through an inductive element to the first connection point, a first feeding path is formed from the feeding point through the inductive element to the first connection point, the feeding point is further coupled through a capacitive element to the second connection point, a second feeding path is formed from the feeding point through the capacitive element to the second connection point, and the feeding point is further coupled through a matching circuit to a signal source;

wherein the inductive element is directly connected to the feeding point, and the capacitive element is directly connected to the feeding point.

2. The communication device as claimed in claim 1, wherein the antenna element operates in a first band and a second band, and frequencies of the first band are lower than those of the second band.

3. The communication device as claimed in claim 2, wherein the first band is substantially from 698 MHz to 960 MHz, and the second band is substantially from 1710 MHz to 2690 MHz.

4. The communication device as claimed in claim 2, wherein in the first band, an absolute value of a reactance of the capacitive element is greater than that of the inductive element.

5. The communication device as claimed in claim 2, wherein when the antenna element operates in the first band, the metal element is fed through the first feeding path from the signal source.

6. The communication device as claimed in claim 2, wherein in the second band, an absolute value of a reactance of the capacitive element is less than that of the inductive element.

7. The communication device as claimed in claim 2, wherein when the antenna element operates in the second band, the metal element is fed through the second feeding path from the signal source.

8. The communication device as claimed in claim 1, wherein the capacitive element is a chip capacitor or a distributed capacitor.

9. The communication device as claimed in claim 2, wherein a length of the metal element is shorter than 0.125 wavelength of the lowest frequency of the first band.

10. The communication device as claimed in claim 2, wherein the matching circuit is configured to increase bandwidth of the first band and the second band.

11. A communication device, comprising:

a ground element; and an antenna element, comprising a metal element, wherein the metal element is disposed adjacent to an edge of the ground element, the antenna element has a feeding point, the metal element has a first connection point and a second connection point, the feeding point is coupled through an inductive element to the first connection point, a first feeding path is formed from the feeding point through the inductive element to the first connection point, the feeding point is further coupled through a capacitive element to the second connection point, a second feeding path is formed from the feeding point through the capacitive element to the second connection point, and the feeding point is further coupled through a matching circuit to a signal source;

wherein the antenna element operates in a first band and a second band, and frequencies of the first band are lower than those of the second band;

wherein the first band is substantially from 698 MHz to 960 MHz, and the second band is substantially from 1710 MHz to 2690 MHz.

12. A communication device, comprising:

a ground element; and an antenna element, comprising a metal element, wherein the metal element is disposed adjacent to an edge of the ground element, the antenna element has a feeding point, the metal element has a first connection point and a second connection point, the feeding point is coupled through an inductive element to the first connection point, a first feeding path is formed from the feeding point through the inductive element to the first connection point, the feeding point is further coupled through a capacitive element to the second connection point, a second feeding path is formed from the feeding point through the capacitive element to the second connection point, and the feeding point is further coupled through a matching circuit to a signal source;

wherein the antenna element operates in a first band and a second band, and frequencies of the first band are lower than those of the second band;

wherein in the first band, an absolute value of a reactance of the capacitive element is greater than that of the inductive element.

13. A communication device, comprising:

a ground element; and an antenna element, comprising a metal element, wherein the metal element is disposed adjacent to an edge of the ground element, the antenna element has a feeding point, the metal element has a first connection point and a second connection point, the feeding point is coupled through an inductive element to the first connection point, a first feeding path is formed from the feeding point through the inductive element to the first connection point, the feeding point is further coupled through a capacitive element to the second connection point, a second feeding path is formed from the feeding point through the capacitive element to the second connection point, and the feeding point is further coupled through a matching circuit to a signal source;

wherein the antenna element operates in a first band and a second band, and frequencies of the first band are lower than those of the second band;

wherein in the second band, an absolute value of a reactance of the capacitive element is less than that of the inductive element.

14. A communication device, comprising:

a ground element; and an antenna element, comprising a metal element, wherein the metal element is disposed adjacent to an edge of the ground element, the antenna element has a feeding point, the metal element has a first connection point and a second connection point, the feeding point is coupled through an inductive element to the first connection point, a first feeding path is formed from the feeding point through the inductive element to the first connection point, the feeding point is further coupled through a capacitive element to the second connection point, a second feeding path is formed from the feeding point through the capacitive element to the second connection point, and the feeding point is further coupled through a matching circuit to a signal source;

wherein the capacitive element is a chip capacitor or a distributed capacitor.

* * * * *